US005114094A

United States Patent [19]

Harris

[11] Patent Number: 5,114,094

[45] Date of Patent: May 19, 1992

[54] NAVIGATION METHOD FOR SPINNING BODY AND PROJECTILE USING SAME

[75] Inventor: James C. Harris, Vienna, Va.

[73] Assignee: Alliant Techsystems, Inc., Edina, Minn.

[21] Appl. No.: 602,179

[22] Filed: Oct. 23, 1990

[51] Int. Cl.[5] ..... F42B 10/28

[52] U.S. Cl. ..... 244/3.22

[58] Field of Search ..... 102/384; 244/3.21, 3.22

[56] References Cited

U.S. PATENT DOCUMENTS

| | | | |
|---|---|---|---|
| 3,028,807 | 4/1962 | Burton et al. | 244/3.22 |
| 3,034,434 | 5/1962 | Swaim et al. | 244/3.22 |
| 3,568,954 | 3/1971 | McCorkle | 244/3.22 |
| 3,937,423 | 2/1976 | Johansen | 244/3.22 |
| 4,300,736 | 11/1981 | Miles | 244/3.22 |
| 4,347,996 | 9/1982 | Grosso | 244/3.22 |
| 4,356,770 | 11/1982 | Atanasoff et al. | 102/384 |
| 4,384,690 | 5/1983 | Brodersen | 244/3.22 |
| 4,560,120 | 12/1985 | Crawford et al. | 244/3.22 |
| 4,568,040 | 2/1986 | Metz | 244/3.22 |
| 4,674,408 | 6/1987 | Stessen | 102/384 |
| 4,676,456 | 6/1987 | Grosso et al. | 244/3.21 |

FOREIGN PATENT DOCUMENTS

| | | | |
|---|---|---|---|
| 1444029 | 7/1976 | United Kingdom | 102/384 |

*Primary Examiner*—Charles T. Jordan

*Attorney, Agent, or Firm*—Finnegan, Henderson, Farabow, Garrett & Dunner

[57] ABSTRACT

A method for navigating a spinning body to intercept an object includes configuring the body to have a predetermined nominal precessional rate and measuring actual changes in the precessional rate. The angular position of the sensed object is corrected for precessional error based on estimates using the predetermined rate adjusted by the measured actual changes in the precessional rate as determined by measuring accelerations about axes orthogonal to the spin axis. Changes in spin rate are determined via measuring acceleration about the spin axis and the sensed object angular position corrected for this error as well. Discrete thrusters are activated to propel the body in a direction to reduce differences between corrected object angular position and a predetermined position which may be the previously corrected sensed position. The projectile using the above method includes a cylinder body having a face-mounted sensor, a moment of inertia ratio of nominally 2:1 to yield an asymptotically imbalanced body, and two matched accelerometers pairs to determine changes in precessional rate. Changes in spin rate are determined by another matched accelerometer pair. The accelerometer pairs are mounted in a plane orthogonal to the spin axis and passing through the body CG.

25 Claims, 5 Drawing Sheets

NAVIGATION METHOD FOR SPINNING BODY AND PROJECTILE USING SAME

BACKGROUND OF THE INVENTION

1. Field of the Invention

This invention pertains to autonomously guided devices employing aperiodic discrete proportional navigation. More specifically, this invention pertains to a guided projectile in the shape of a right cylinder employing spin about its longitudinal axis for gyroscopic stabilization and circumferential explosive impulse thrusters for propulsion, and a method for guiding same.

2. Description of the Prior Art

The general application of aperiodic discrete proportional navigation has been established for some time. The theoretical foundations of proportional navigation were first revealed in Soviet Technical publications over four decades ago, and began to appear in open technical publications in the United States shortly thereafter. Subsequently, they have been widely adapted to commercial and military guidance applications, including virtually all precision guided weapons around the globe. Various theoretical formulations of proportional navigation have been put forward in open literature, including both analog (continuous sensing and control) and discrete (discontinuous sensing and control) proportional navigation. The particular manifestation of the generic proportional navigation principle which is referred to as "discrete proportional navigation" provides a generic, theoretical framework within which many guidance systems mechanizations including that of the present invention are founded.

Simply stated, discrete proportional navigation is defined as discretely induced adjustments to the device velocity components, based on sensed changes in relative attitude to an approaching object or target, which permit a device to achieve an accurate, fixed relative orientation to, and intercept with, that approaching object. In its two basic variations, the designer may choose to either a) vary the magnitude of periodically applied thrusters (period variant); or to b) vary the time intervals between application of fixed magnitude thrusters (aperiodic variant). The generic aperiodic variant of discrete proportional navigation is often selected because of certain intrinsic advantages.

Low cost, extended storage life, and packaging advantages characteristic of fixed magnitude solid propellant thrusters are known and have led to broad application in a host of guided system control applications. Because of the high shock level associated with the firing of each solid propellant thruster, the thrusters are generally rigidly mounted into the primary device structure. This avoids having to otherwise oversize any associated gimbal drive assemblies to accommodate intermittent high torque moments. Body fixed discrete thrust control is a generic attribute associated with virtually all applications of solid propellants for guided system control. An example may be found in U.S. Pat. No. 4,674,408 by Lothar Stessen.

The prior art teaches the method of body fixed sensing of an external approaching object. To implement any form of proportional navigation, it is necessary for the guided device to incorporate some form of external object sensing. The particular sensor technology commonly employed in such applications includes visual spectra, infrared spectra, millimeter wave and microwave radar, among others. In continuous proportional navigation, regardless of the sensor technology being employed, the external object sensor is most commonly mounted in a tracking gimbal assembly in order to permit gimbal rate gyros to measure angular rates corresponding to the external target's relative movement. In either the periodic or the aperiodic form of discrete proportional navigation, the necessity to measure external target relative angular rates is removed, since the guidance principle is based instead on introducing thrusting only when cumulative changes in the relative angle exceed a threshold. Accordingly, gimbal rate measurements are no longer required, provided that body coning motion is successfully removed from measured relative angle changes.

Furthermore as previously established if aperiodic discrete proportional navigation using body fixed solid propellant thrusters is to be incorporated, regardless of the sensor technology being employed, the external object sensor will be subjected aperiodically, to high torque moments, if the sensor is gimbal mounted. The necessity to overcome the gimbal drive assembly inertia would lead to greater device size and possibly higher cost. For these clear and compelling reasons, guided device applications of aperiodic discrete proportional navigation using solid propellant thrusters has commonly incorporated both the external object sensor and the solid propellant thrusters directly into the primary structure of the device. An example of a spin stabilized body fixed sensor can be found in U.S. Pat. No. 4,560,120 by Crawford et al.

Such devices having body fixed sensors typically require some form of an inertial reference system to measure and correct for the changes in the rotational motion of the device from acceleration and deceleration due to the thruster system and precessional error due to the "wobble" of the guided device in flight. Prior to the present invention various approaches to compensate for the spin error and the precessional error were attempted. One known method was to disregard the errors and to rely on the accurate initial placement of the guided device with respect to the external object, such that only a few solid propellant thruster firings would be required to position the device. This design approach was subsequently abandoned as an unrealistic approach. Another design approach has been to incorporate a strap-down inertial system which continuously senses the deviation of the device body about an established reference rim using gyroscopic (inertial) components. See e.g. U.S. Pat. No. 4,676,456 by Grosso et al. Although the performance provided by this approach has been acceptable, failure to meet realistic costs, size and weight goals has been a significant problem.

Finally a design approach was attempted utilizing balanced guided device moments of inertia, i.e. 1:1:1, together with passive and active device balancing features that theoretically would result in entirely eliminating precessional error. Because of the relatively narrow gyrodynamic stability envelope for such a system, and the consequent prohibitive cost of the manufacturing and balancing tolerances that would be required to actually make this approach practical, a moderately large, but slow precessional motion is actually experienced. The residual precessional motion remains large enough to require the incorporation of active deprecessional torquing to bound the magnitude of precession experienced and to incorporate gyros to measure residual precessional biases.

SUMMARY OF THE INVENTION

It is an object of the present invention to provide a method of navigation for a spinning body, and a projectile utilizing same, which method does not require the use of high cost inertial elements such as gyroscopes to measure or compensate for position error due to precision and despin, and which does not require the use of stringent and costly manufacturing tolerances to minimize precessional error.

In accordance with the present invention, as embodied and broadly disclosed herein, the method of navigating a spinning body for intercepting an object, the body having a spin axis, an angular momentum vector, an axial end face with object sensor means located thereon, and propulsion means including discrete thruster means, comprises the steps of sensing the angular position of the object with respect to the body spin axis; correcting the sensed angular position of the object for angular position error due to precession of the body; comparing the corrected object angular position with a predetermined object angular position to compute a difference; and firing the discrete thruster means to provide one or more discrete thrusts in a direction to reduce the difference whenever the difference exceeds a predetermined limit. Specifically, the correcting step includes the substeps of estimating the angular error between the body spin axis and the angular momentum vector of the body based on a predetermined precession rate relative to the spin rate, and measuring the actual deviation in the precession rate from the predetermined rate. Importantly, the method also includes the preliminary step of forcing the body to precess about its angular momentum vector at the predetermined rate.

Preferably, the discrete thruster means includes a plurality of discrete radial thrusters distributed about the periphery of the body in a plane orthogonal to the spin axis and passing through the CG of the body, and the firing step includes the step of firing in a sequence to minimize changes in the precessional rate of the body.

It is also preferred that the precession forcing step includes configuring the body to have an asymptotically imbalanced moment of inertia about the spin axis. For a body which is substantially cylindrical and is spun about its longitudinal axis, the body is configured to have a nominal moment of inertia ratio approaching the theoretical limit of 2:1.

It is still further preferred that the actual deviation determining substep includes ascertaining the acceleration of the body about each of a pair of mutually orthogonal axes which are also orthogonal to the body spin axis.

It is yet further preferred that the correcting step include correcting for the angular position error due to changes in the spin rate of the body and includes the step of ascertaining the acceleration about the spin axis.

Still further in accordance with the present invention, as embodied and broadly disclosed herein, the projectile for a target intercept system wherein the projectile is rotatably spun upon launch, comprises a body having a spin axis, an axial end face, a center of gravity CG, and, following launch, an angular momentum vector; controllable discrete propulsion means positioned on the body for propelling the projectile in a plane normal to the body spin axis and passing through the body CG; and target sensing means for sensing target angular position with respect to the body spin axis, the target sensing means including a body fixed sensor positioned on the axial end face and spaced from the spin axis. The projectile also includes navigation means fixed in the body and operatively connected to the target sensing means and to the discrete propulsion means, for controlling the propulsion means to maintain an intercept course following launch. The navigation means includes means for correcting the sensed target angular position for angular position error due to precession of the body and means for comparing the corrected target angular position with an predetermined angular threshold to compute an angular threshold exceedance and for activating the discrete propulsion means to propel the body in a direction to decrease the difference whenever the difference exceeds the predetermined threshold value, in either polarity. The correcting means includes means for estimating angular error between the spin axis of the body and the angular momentum vector of the body based on a predetermined precession rate relative to the spin rate and means for measuring deviations in the body precessional rate from the predetermined rate. Importantly, the body includes means for forcing the body to precess about its angular momentum vector at near the predetermined rate.

Preferably the projectile body is substantially cylindrical with the spin axis being the longitudinal axis of the cylinder, and the precession forcing means includes a mass distribution about the spin axis yielding a nominal moment of inertia ratio approaching the theoretical limit of 2:1.

It is also preferred that the deviation measuring means includes two pairs of nominally matched accelerometers mounted in the body in coupled, opposed relationship in a mounting plane orthogonal to the spin axis of the body. Each of the accelerometer pairs is orthogonal to the other, and each accelerometer of each of the two pairs is aligned to be sensitive to linear acceleration in the spin axis direction.

It is still further preferred that the navigation means includes spin error correcting means for correcting the sensed target angular position error due to changes in the spin rate of the body. The spin rate change error determining means can include a third pair of nominally matched accelerometers mounted in coupled, opposed relationship in the body in a mounting plane orthogonal to the spin axis of the body. The accelerometers of the third pair are aligned to be sensitive to linear acceleration along a direction orthogonal to the spin axis of the body.

And it is yet further preferred that the discrete propulsion means includes about 32 to 64 solid propellant thrusters spaced about the body periphery in a plane passing through the body CG, and that the body includes an opposed axial end surface. The propulsion means also can include means positioned on the opposed end surface for propelling the projectile along the spin axis.

The navigation method and projectile of the present invention as disclosed in general terms above and in more detail hereinafter can advantageously be configured as a high performance spinning interceptor. As described below, a preferred embodiment of the present invention is a military target intercept system entitled Discrete Impulse Spinning Hardbody Kill ("DISK"), although the present invention is not intended to be restricted to the described application, or to military applications, but only by the appended claims and their equivalents.

DISK's primary maneuver authority is omni directional, within a plane of maneuver normal to its spin axis. Unlike conventional missiles, rockets and guns, it does not require aiming prior to being dispensed. This translates into a significant reaction time advantage that may be useful for certain scenarios. Within the primary plane of maneuver, DISK contains sufficient thrust authority that if employed all in the same direction, would propel the DISK at a velocity in excess of MACH 1. Nevertheless, the delicacy available employing this control authority enables DISK to achieve terminal CEP accuracy (Circular Error Probable) substantially better than one foot, about the sensor track point.

DISK also incorporates a secondary axis of maneuver authority along its spin axis, which is coincident with the sensor axis. The DISK thrust authority along this axis is intended to enable DISK to establish in excess of a 100 knot velocity against hovering targets, as well as to increase the kinetic energy lethality of DISK against approaching air targets.

The above described navigation method is very precise about the sensor aimpoint, allowing DISK to enjoy a degree of kinetic energy lethality against both hovering and approaching targets. The unique acceleration signature associated with the air-target/DISK impact is employed to trigger a high energy unitary self-forging fragment, which due to the nature of the DISK guidance, is guaranteed to be very precisely aligned with the target. Almost simultaneously, the remaining one-fourth of the DISK mass fraction, which is HE, is ignited. Interscoring of the DISK body results in disintegrating the body into omni directional high energy schrapnel in an explosion that initiates while in contact with the air target. The combination of the kinetic energy exchange, unitary and in contact omni directional fragmentation warhead effects are expected to make DISK a particularly effective weapon against a wide variety of small and large air targets. The combination of DISK quick reaction time and extended range coverage capability suggest a variety of applications to both forward area and point area defense problems which would supplement current DoD capabilities. The short reaction time feature, coupled with its highly accurate terminal homing accuracy, would tend to make DISK useful for short range, quick reaction time applications such as air base defense, cruise missile defense, defense for radars against ARM weapons ship defense, intercepting incoming mortar rounds, and a host of other applications in which the incoming threat is aimed at an asset of sufficient value to justify the expenditure of an under $10,000 class weapon. The wide coverage radius capabilities, coupled with its highly accurate terminal homing accuracy, would tend to make DISK useful as a supplement to Army air defense missiles and AAA. Its effective altitude limit is expected to be at least 10,000 feet. Its low signature properties, its potential for dual mode sensor employment, its high maneuverability and its combination of lethal mechanisms would be expected to make DISK a particularly useful adjunct to current air defense capabilities against a wide variety of air defense threats.

DESCRIPTION OF THE PREFERRED EMBODIMENT

Figure 1:
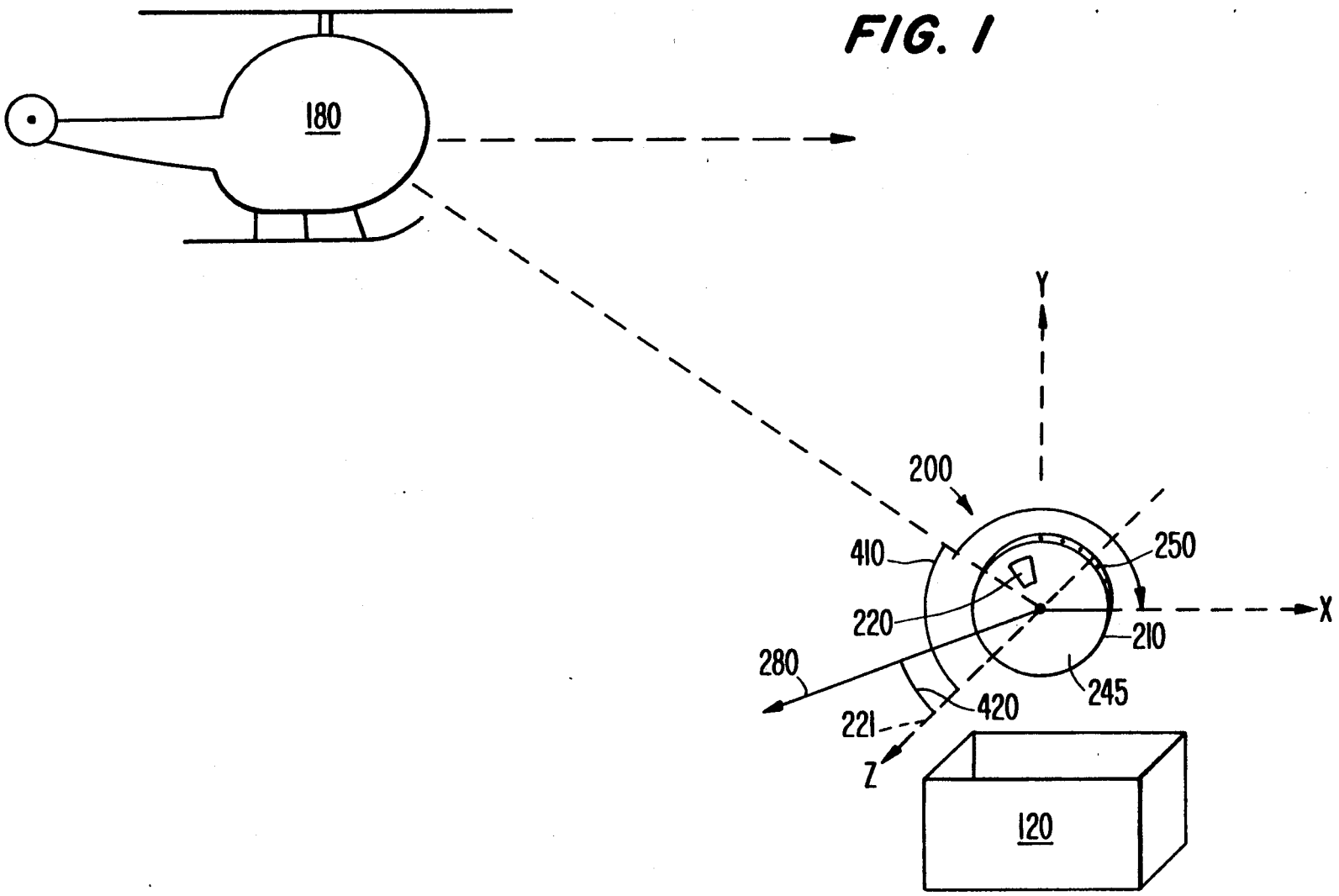
FIG. 1 is a perspective view of one embodiment of the present invention, namely the DISK device, shown in a helicopter target intercept application.

As embodied herein, DISK is a right circular cylindrical projectile which spins about its longitudinal axis. The DISK device designated generally in FIG. 1 as 200, includes a body 210 which is positioned such that its longitudinal axis 221 is relatively parallel with the ground. The DISK device moves in an omni-directional motion. More specifically, it can move in the vertical x-y plane of the device with longitudinal axis 221 being parallel to the z axis (which is parallel to the ground in FIG. 1) and it can also move in the z direction. DISK incorporates a forward looking sensor 220 which is positioned slightly off the longitudinal axis on the forward face 245 of the DISK device. By incorporating the spin about the longitudinal axis, the forward looking sensor is able to track an aerial target and subsequently move to the threat. The DISK device further has a plurality of thrusters 250 located about its peripheral surface in the x-y plane. The thrusters are utilized to position the DISK device within its two-dimensional plane of operation. Additional thrusters (not shown in FIG. 1) can be located on the rear axial end face to provide forward motion in the z direction.

One application for the DISK device would be as an aerial mine or an anti-helicopter mine. As is depicted schematically in FIG. 1, DISK projectile 200 is launched from ground base dispenser 120. The dispenser 120 launches the DISK device 200 approximately two seconds prior to the calculated impact. DISK body 210 is first spun-up to a high rpm about longitudinal axis 221, for example 20 Hz (1200 rpm), launched, and upon the sensor 220 mounted on forward end face 245 locating the target 180, and by navigation means to be discussed in more detail hereinafter, positions itself by firing thrusters 250 located about the periphery of the device 200 such that the target 180 will come in contact with the DISK device 200.

Figure 2A:
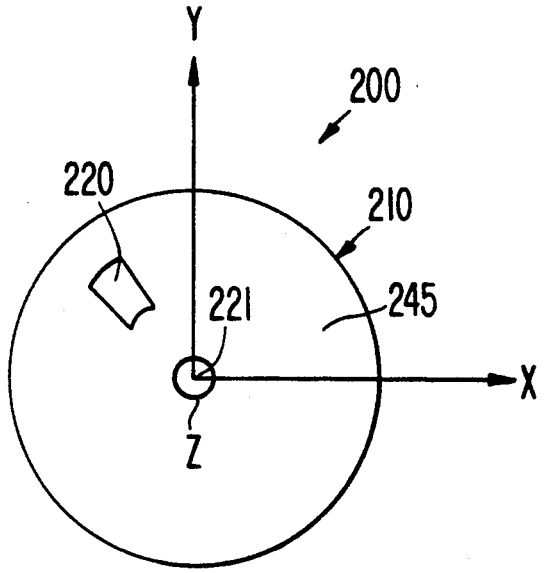
FIGS. 2A and 2B are end and side plan views of the DISK device of FIG. 1 and illustrate the placement of the sensor means on the forward face of the DISK device and solid propellant thrusters on the periphery and on the axial face opposed to the face on which the sensor is located.
Figure 2B:
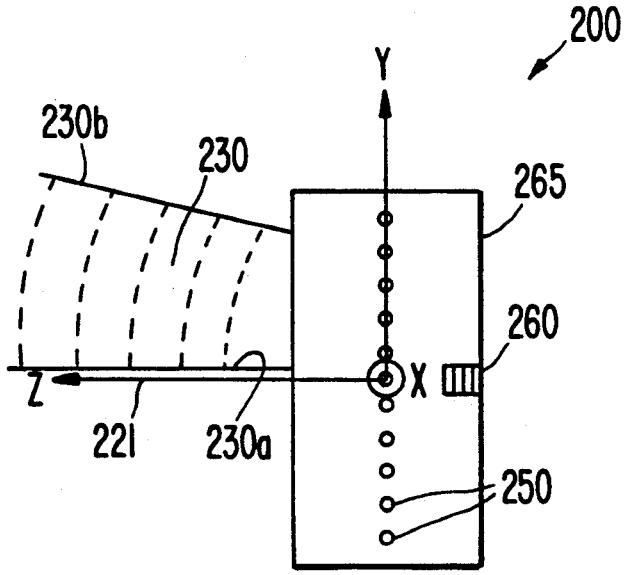

FIGS. 2A and 2B further illustrate the DISK device depicted in FIG. 1. DISK device 200 has a body 210 in the shape of a right circular cylinder with a longitudinal axis 221 which is also the spin axis. Forward face 245 of the DISK device has a forward looking sensor 220 located slightly off the longitudinal axis as mentioned previously. The DISK body 210 spins about its longitudinal axis 221 giving a nominal field of view 230 bounded by inner and outer conical surfaces **230*a* and 230*b* respectively. Spin axis 221 is approximately coincident with the inner edges of the sensor's field of view. A plurality of axial thrusters 260 are provided on rear axial face 265** to provide movement along the z axis, if required. As depicted in FIG. 1, sensor 220 locates the target such as helicopter 180, and, in manner known to those skilled in the art, the output of sensor 220 can be used to establish an angular position of the target (designated angle 410) with respect to spin axis 221. This position is used by the DISK navigations means to control thrusters 250 to maintain an intercept course for DISK body 210 in a manner to be explained in more detail hereinafter.

In order to contain sensor costs to a minimum the DISK concept has been developed around the use of a body mounted target centroid detector 220 of the fixed beam type with body spin providing the sensor scanning mechanism. Target sensors of this type are known to those skilled in the art. As the sensor beam is swept across the target image, the sensor 220 must be capable of establishing repeatedly an indication of the radial angle of the target with respect to the spin axis to an acceptable resolution. For sensor cost reduction purposes, the DISK concept has been formulated such that relatively large fixed angular biases and variations away from the linearity in the measurement of the radial and rotational angles of the target will not degrade DISK performance. It is shown that an effective rotational target centroid resolution of a few degrees, extending from around 10° to about 30° off the spin axis, with radial detection angle resolution of a few milliradians will satisfy most intercept geometry situations without adversely degrading DISK performance. The sensor noise and detection sensitivity requirements are determined by the target signature characteristics and the desired detection range. Typically, DISK will require a detection range of from 200 meters to 1,000 meters depending upon the intended application.

DISK is required to navigate to a target which has the ability to move in more than one direction. For instance, if the target which the DISK device is tracking were to remain in a single altitude the DISK device could track that device easily. However, since the target which the DISK device must intercept has the ability to change altitudes as well as move in a side-to-side motion, thus, not being restricted to a forward motion, the DISK device navigation means must be able to track these motions and respond accordingly with appropriate instructions to the thrusters 250 and 260. This is classified as "cross-axis" guidance or navigation.

Figure 3:
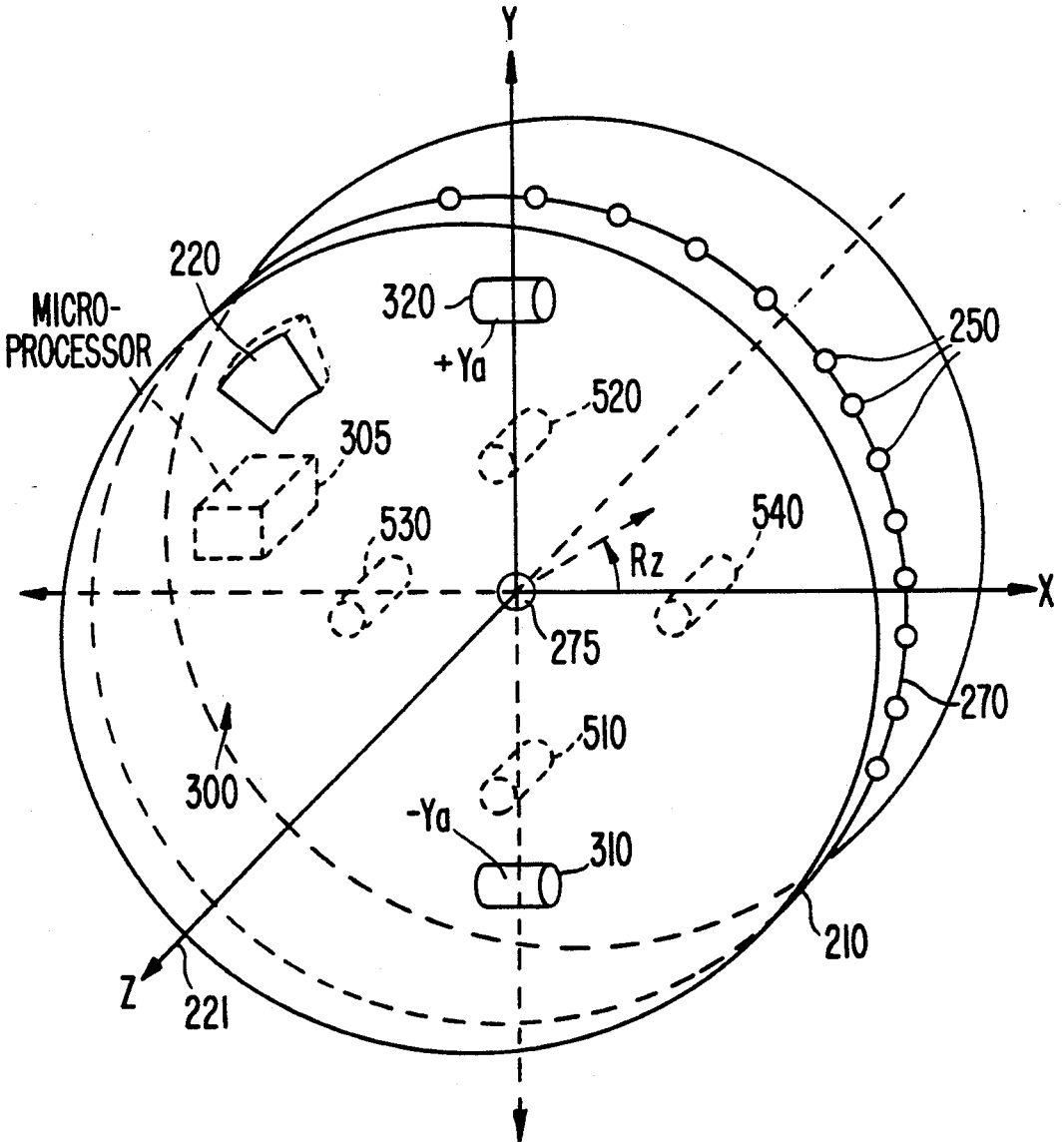
FIG. 3 is an enlarged perspective view of the DISK device of FIG. 1 and illustrates various navigation system components, including the placement of the accelerometer pair for the sensing of rotational acceleration, and the accelerometer pairs for sensing precessional acceleration.

In "cross axis" navigation it is necessary to distinguish between target cross axis motion and apparent target cross axis movement induced by changes in DISK body 210 spin rate and precession of DISK body 210. As embodied herein, DISK 200 employs navigation mean designated generally by the numeral 300 in FIG. 3 which receives target angular position information from sensor 220 and processes it, in appropriate processor means (depicted schematically as 305), to correct for spin rate changes and for precession. Specifically, navigation means 300 includes means for ascertaining the acceleration (including deceleration) of body 210 about spin axis 221. As best seen in FIG. 3 DISK 200 employs an accelerometer couple, with two accelerometers 310, 320 mounted symmetrically at positions −Ya and +Ya along the DISK y axis in plane 270 which passes through the center of gravity ("CG") 275 of body 210. The accelerometers 310 and 320 must be mounted in opposition. The accelerometers are mounted so as to be each sensitive to accelerations in the x axis. If perfectly matched the measured difference between their sensed accelerations will cancel out x axis linear accelerations leaving only the z axis rotational accelerations. As shown later a mismatch of about 0.2 to 0.5 percent over a limited dynamic range can be tolerated.

Accelerometers 310, 320 can be mounted in body 210 in another plane orthogonal to axis 221, but CG plane 270 is preferred because the gain of the instruments is maximized. Also, accelerometers 310, 320 could be positioned at alternate positions −Xa, +Xa to be sensitive to linear accelerations along the y axis.

Symbolically the "cross axis" motion is shown as;

$$Azdet=[d(Rz)/dt]*(1-ASE)$$

where Azdet is a measured rotational acceleration at target detection, Rz is the rotational angle of the DISK device and ASE is the normalized mismatch between the two accelerometers 310, 320. At the estimated completion of successive disk rotations the sensed rotational acceleration is expected to update the estimated DISK spin period. In accordance with this simple first order expansion relationship, the devices actual period of rotation is;

$$\text{Period}' = \text{Period} - Azdet * \frac{[\text{Period}^3]}{2\pi}$$

For the few seconds of DISK maneuvering a high order power series expansion is not required to correct for DISK despin effects, as the cumulative truncation errors do not have long to propagate. In addition, at each thrust impulse during the DISK guidance, imperfect alignment of thrust impulses will produce torques which have the effect of discretely increasing or decreasing spin period. By integrating Azdet over the duration of the thrust impulse, it follows from series expansion that;

$$\text{Period}' = \text{Period} - [\text{Period}^2] * \text{integral} \frac{Azdet}{2\pi}$$

The above calculations are carried out by processor means 305 which can be a microprocessor or microchip hardwired with the calculational steps. See FIG. 3, with interconnections between processor means 305 and sensor 220, accelerometers 310 and 320, (and accelerometers 510, 520, 530, and 540 to be discussed hereinafter) and thrusters 250 being omitted for clarity. One skilled in the art would be able to construct and program the navigation means including processor means 305 given the present disclosure as detailed above and hereinafter.

The next error DISK navigation means 300 must correct for is precession. Precession of a rotating body having off-nominal component tolerances and subject to forces not passing though the body CG cannot be avoided. Precession can occur initially as the result of uneven launch forces, and it will accumulate as successive thruster impulses are fired due to the imperfect thruster alignment. Since a dominant objective for the present invention is to minimize projectile cost, the projectile and navigation method must accommodate relatively large thruster misalignment tolerances, while maintaining acceptable navigation system performance. However, the fact that the sensor is fixed to the spinning body causes the induced body precessional motion to couple into the sensor measurement as perceived target motion. Unless adequately compensated for, this coupling effect will completely mask the true motion.

In a clear departure from conventional navigational methods wherein the tendency of the spinning body to precess is minimized to the extent practicable, the present method deliberately contemplates and encourages significant but predetermined precessional motions of the body. In the present invention, the precession rate is calculated based on the predetermined precessional motion with respect to the total angular momentum vector of the spinning body and actual deviations from the precessional rate are determined and used to adjust the calculated rate. The sensed target angular position is then corrected for precession error using the adjusted value. Hence, the method and navigation mean of the present invention employ both "passive" and "active" filtering of the sensor information.

This method allows the manufacturing tolerances for the body and navigation components to be relaxed, lowering costs correspondingly. This method also allows the use of less expensive navigation system components for determining deviations from the predetermined precession rate as will be apparent from the succeeding discussion.

The DISK embodiment achieves this combined "passive" and "active" filtering as follows. First, an exact integer value of the DISK moment of inertia ratios (Izz/Ixx)=(Izz/Iyy) would cause the cumulative DISK precession angle to be zero at successive complete DISK rotations. As the target intercept miss distance is reduced to zero by DISK guidance the target images would become stationary in the DISK field of view at successive detections, thereby eliminating any terminal guidance error due to the DISK precession. However, the objective of low DISK unit cost requires that the DISK design concept must accommodate relatively large moment of inertia imbalances, while maintaining acceptable guidance system performance.

Hence the DISK body 210 is configured for a nominal integer moment of inertia ratio approaching 2:1, but with an allowable normalized manufacturing tolerance of about 10 percent. The nominal 2:1 moment of inertia ratio causes the body to be asymptotically imbalanced but with a predetermined precession rate to nominally match the spin rate. Hence, the angle 420 between body spin axis 221 and body angular momentum vector 280 (see FIG. 1) can be calculated and used to adjust the sensed target angular position. However, for up to a 10 percent imbalance in moment of inertia ratio the precession angle will vary over successive spin periods by up to 36°. This remaining precession error without additional compensation would produce intolerable DISK guidance errors.

As embodied herein, navigation means 300 includes additional means for compensating for residual precession errors due to manufacturing tolerances yielding non-integer moment of inertia ratios, and for thruster firings, which compensating means utilizes two accelerometer couples to measure the DISK x-axis and y-axis precessional acceleration as shown in FIG. 3, namely the DISK accelerometer couples 510, 520, and 530, 540. The accelerometers 510, 520, 530, and 540 are each mounted in CG plane 270 and oriented to be sensitive to acceleration in the z axis; however, each accelerometer in each couple is mounted in opposition to its partner so as to cancel linear accelerations along the z axis while additively sensing angular accelerations about the desired DISK axis. The accelerometers can be mounted in another orthogonal plane but the CG plane is preferred for reasons stated previously.

Unlike the DISK spin accelerometer couple 310, 320, however, the matching tolerance in accelerometer couples 510, 520 and 530, 540 is much more relaxed, on the order of 10 percent. The reason for the relaxed tolerance is the fact that the near integer moment of inertia ratios have already reduced precessional target motion-sensor coupling to such an extent that only limited additional compensation is required. Precession is a process of harmonic motion. Accordingly, the precessional acceleration in each axis (ARx, ARy) is related to the corresponding precession angle in each axis (Rx, Ry) by the mathematical relationships;

$$Rx=(Rx-bias)-ARx/(PRERAT^2)$$

$$Ry=(Ry-bias)-ARy/(PRERAT^2)$$

wherein PRERAT is the known predetermined precession rate and Rx-bias and Ry-bias are unknown but constant. Since the DISK nominal, predetermined precession rate is known, the measured precessional acceleration (ARx, ARy) can be scaled by $1/(PRERAT^2)$ to correspond to biased values of actual DISK precession angles (Rx, Ry). In DISK guidance, changes in target "cross track" and radial angles provide the basis for DISK guidance. Thus, if the biased or precessional angle estimates are added to the DISK detected sensor angle, changes in target line of sight angles will not be influenced by the bias terms (Rx-bias, Ry-bias). These constant biases will be cancelled out each time a change in line of sight angle is calculated.

The DISK precession compensation principles are illustrated from the following development of mathematical first principles. An understanding of the underlying theories begins with mathematical characterization of the precession free body as the DISK device spins. The rotational moments about the x and y axis are in accordance with their relationships:

$$Mx=Ixx*d[VRx]/dt+(Izz-Iyy)*VRz*VRy$$

$$My=Iyy*d[VRy]/dt+(Ixx-Izz)*VRz*VRx$$

wherein (VRx, VRy, VRz) are the rotational angular rates about the respective DISK axes. As long as DISK thrusters are not being fired these rotational moments are zero. The corresponding harmonic motion equations which characterize the DISK body precession result directly as:

$$d[VRx]/dt=Cx*VRz*VRy=ARx$$

$$d[VRy]/dt=-Cy*VRz*VRx=ARy$$

wherein for the notational convenience the terms (Cx, Cy) have been defined as:

$$Cx=[Izz-Ixx)/(Ixx]+[(Ixx-Iyy)/Ixx]$$

$$Cy=[(Izz-Iyy)/Iyy]+[Iyy-Ixx)/Iyy]$$

For convenience in relating these harmonic motion equations to related gyrodynamic manufacturing and balancing relationships, it is useful to make the following definitions at this point in the development:

K=Izz/Ixx: (moment of inertia ratio)

Exy=(Ixx−Iyy)/Ixx: (inertial imbalance)

KO=(nominal value of moment of inertia ratio)

Ek=−1+K/KO (moment of inertia ratio tolerance

It follows by direct substitution that Cx, Cy are related to (KO, Exy, Ek) as follows:

$$Cx=(KO-1)+KO*Ek+Exy$$

$$Cy=(KO-1)+KO*Ek-Exy$$

The DISK design concept utilizes the integer choice of KO equal to 2. Ek corresponds to the normalized manufacturing tolerance provided that exact integer moments of inertia ratio ($0<|Exy|<1$). The parameters Ek and Exy are cost drivers and KO, Ek and Exy are performance drivers; it is therefore useful to understand directly their relationship to the DISK harmonic precessional behavior. The precessional harmonic response dictated by the pair of differential equations is equivalently characterized in the DISK simulation model via corresponding finite difference equation pairs below:

Precessional Angular Rates:

$$VRx(t_o+dt)=VRx(t_o)*\cos[PRERAT*dt]+VRy(t_o)*\sin[PRERAT*dt]$$

$$VRy(t_o+dt)=-VRx(t_0)*\sin[PRERAT*dt]+VRy(t_o)*\cos[PRERAT*dt]$$

Precessional Angles:

$$Rx(t_o+dt)=Rx(t_o)+[VRx(t_o)/PRERAT]*\sin[PRERAT*dt]+[PRECPLX*VRy(t_o)/PRERAT]*(1-\cos[PRERAT*dt])$$

$$Ry(t_o+dt)=Ry(t_o)/PRERAT]*\sin[PRERAT*dt]-[PRECPLY*VRx(t_o)/PRERAT]*(1-\cos[PRERAT*dt])$$

wherein the DISK precessional rate (PRERAT) is:

$$PRERAT=VRz*SQRT(Cx*Cy)$$

and the two cross-coupling coefficients are:

$$PRECPLX=SQRT(Cx/Cy)$$

$$PRECPLY=SQRT(Cy/Cx)$$

Consider now the relative geometry between the spinning and precessing DISK body and target. Defining a right-handed inertial coordinate frame [Xi, Yi, Zi]the initial DISK coordinates are:

$$[Xbi(t_o),\ Ybi(t_o),\ Zbi(t_o)]=[0,0,0]$$

Since it is initially at rest, DISK velocity components are:

$$[VXbi(t_o),\ VYbi(t_o),\ VZbi(t_o)]=[0,0,0]$$

The DISK body is subjected to gravitational acceleration, such that:

$$[AXbi(t),\ AYbi(t),\ AZbi(t)]=(0,-g,0)$$

The initial DISK z axis is identical to the initial spin axis. Without loss of generalization, the basic principles of DISK may be explained as follows. Let DISK be assumed to be orientated such that the z axis is horizontal or parallel to Zbi, and the initial DISK of axis be defined to be oriented in the upward direction, perpendicular to the ground. The initial target coordinates are $Xti(t_o)$, $Yti(t_o)$ and $Zti(t_o)$, with velocity components [$VXti(t_o)$ and $VYti(t_o)=0$, $VZti(t_o)<0$]. The target is assumed to have only horizontal movement, therefore its Y-axis components of both velocity and acceleration are always presumed to be zero. Initial target heading angle is:

$$HANG=ATN\ [VXti(t_o)/VZti(t_o)]$$

An initial target velocity is:

$$VT=SQRT[VXti(t_o)^2+VZti(t_o)^2]$$

Thereafter, the relative initial coordinates from DISK to the target area are:

$$(X,\ Y,\ Z)=[(Xti-Xbi),\ (Yti=Ybi),\ (Zti=Zbi)]$$

with corresponding velocity components $$[VX,\ VY,\ VZ]=[(VXti-VXbi),\ (VYti-VYbi),\ (VZti-VZbi)]$$

The DISK sensor is aligned to its instantaneous spin axis, where the radial angle between the DISK spin axis and the target is defined as RHO, and the rotational angle of the target with respect to the reference direction is defined as THETA. As the DISK body simultaneously spins and precesses the relative x and y coordinates of the target with respect to the DISK body are:

$$XBODY(t)=X(t)*\cos(Rz(t))+Y(t)*\sin(Rz(t))-Z(t)*Ry(t)$$

$$YBODY(t)=X(t))*\sin(Rx(t)+Y(t)*\cos(Rz(t))+Z(t)*Ry(t)$$

The orientation of the body fixed DISK sensor is defined as being in the direction such that at each target detection XBODY is positive and YBODY is zero. With that definition therefore the body fixed sensor will detect the target when its spin angle Rz(t) satisfies the relationship:

$$X(tdet)*\sin[Rz(tdet)]-Y(tdet)*\cos[Rz(tdet)]=Z(tdet)*Rx(tdet)$$

At this time (t=tdet) the detection rotational angle THETA becomes:

$$THETA=Rz(tdet)$$

and the corresponding radial detection angle is:

$$RHO=ATN[XBODY(tdet)/Z(tdet)]$$

The DISK sensor detection angles [THETA,RHO] provide the primary source of information upon which disk guidance is based. The primary complication in developing a high performance DISK guidance system capability arises from the fact that these detection angles are strongly influenced by the DISK precession angles [Rx(tdet), Ry(tdet)] which are not known. The following development establishes the DISK method for dealing with these two difficulties in a cost effective manner.

Although DISK precessional angles are not directly observable it was explained earlier that a biased estimate of those angles can be developed, on a basis of the use of a nominal, predetermined precession rate together with measured precessional acceleration, which can be made cost effectively. Let us differentiate each term in the equation $Vrx(t_o+dt)$ yielding:

$$ARx(t_o+dt) = -PRERAT*VRx(t_o)*\sin[-PRERAT^2dt] - VRy(t_o)*\cos[PRERAT*dt]$$

Rearranging the terms in $Rx(t_o+dt)$ leaves:

$$Rx(t_o+dt) = [Rx(t_o) - PRECPLX * VRy(t_o)/PRERAT] - (VRx(t_o) * \sin[PRERAT*dt]) - \frac{[VRy(t_o) * \cos(PRERAT*dt)]}{PRERAT} - ((PRECPLX - 1)/PRERAT)*VRy(t_o)*\cos[PRERAT*dt]$$

It can be shown from the previous equations that as long as the normalized imbalance Exy is much less than unity, then:

$$[PRECPLX-1]/PRERAT] = Exy/[((KO-1)+KO)*Ek*PRERAT]$$

Under extremely loose design tolerances the magnitude of the normalized imbalance Exy is not expected to exceed 0.1 and therefore it follows that the third term in the equation is expected to be much smaller than the second term and can therefore be neglected. After dropping a negligible third term it follows from the equations that:

$$Rx(t_o+dt)-(Rx-bias) = ARx(t_o+dt)/PRERAT^2 = ESTRx$$

Through a similar development it follows that:

$$Ry(t_o+dt)-(Ry-bias) = -ARy(t_o+dt)/PRERAT^2 = ESTRy$$

A close estimate of the precession rate PRERAT is known a priori and if desired, can even be measured via intervals between accelerometer signals. Therefore, the accelerometer couple measurements are readily scaled via the factor $1/PRERAT^2$, to provide biased estimates of the two DISK precession angle components [Rx(t), Ry(t)].

The following section establishes that biased estimates of DISK precession angle [Rx(t), Ry(t)] are sufficient for the purposes of implementing DISK guidance. By combining equations for XBODY(t), RHO and $Ry(t_o+dt)$, the following is achieved:

$$TAN[RHO] = (X/Z)*\cos(Rz)+(Y/Z)*\sin(Rz)+ESTRy+(Ry-bias)$$

Accurate terminal guidance is implemented on the basis of change in TAN[RHO]from its initial value. Accordingly, since the initial and successive estimates of TAN[RHO] will all contain the same fixed bias, DISK guidance will not be affected; thus:

$$TAN[RHO'] - TAN[RHO] = (X'/Z')*\cos(Rz') - (X/Z)*\cos(Rz) + (X'/Z')*\sin(Rz') - (Y/Z)*\cos(Rz) + ESTRY' - ESTRY$$

which is valid for any arbitrary fixed bias, Ry−bias.

It will later be shown that rotational guidance is similarly based on a change in THETA from some initial value. Consider now the equation:

$$Y(tdet)*\sin[Rz(tdet)] - Y(tdet)*\cos[Rz(tdet)] = Z(tdet)*Rx(tdet)$$

which defines the condition for target detection, i.e., YBODY=zero. Consider now that THETA is the actual rotational angle at target detection when the DISK body precession is present, and THETA* would have been the rotational angle at target detection if DISK precession had not existed. Thus THETA is defined as:

$$THETA = THETA^* + EPS$$

The angles THETA and THETA* are defined in the relationships:

$$-X*\sin(THETA^*) + Y*\cos(THETA^*) = 0$$

$$-X*\sin(THETA^*+EPS) + Y*\cos(THETA^*+EPS) + Z*Rx = 0$$

Through trigonometric expansion and substitutions it follows, for small angle values of EPS that:

$$EPS = -COTAN(RHO)*Rx$$

Therefore, the estimated change in the rotational detection angle will be:

$$THETA' - THETA = THETA^{*\prime} - THETA^* - COTAN(RHO)*[ESTRIx' - ESTRx] + (COTAN(RHO')) - COTAN(RHO)*Rx - bias$$

DISK guidance in the radial axis will insure that RHO is essentially stationary in the DISK field of view such that a third term in the equation for THETA'-THETA, is safely neglected; therefore the correct estimate for change in THETA will be essentially independent of any arbitrary fixed bias, Rx-bias. Therefore, the fixed bias in the estimation of DISK precession component Rx(t) will not influence the DISK guidance performance, leaving uncertainty in DISK spin rate, Rz(t) as the primary source of DISK guidance errors in rotational axis.

Based on the theoretical discussions of cross-axis and precessional motion, the DISK device utilizes discrete proportional navigation to guide the device within its x-y axis. The discrete maneuver changes in velocity are produced when the cumulative change in corrected relative angle between the maneuvering body and the approaching target exceeds an established threshold value.

Figure 4:
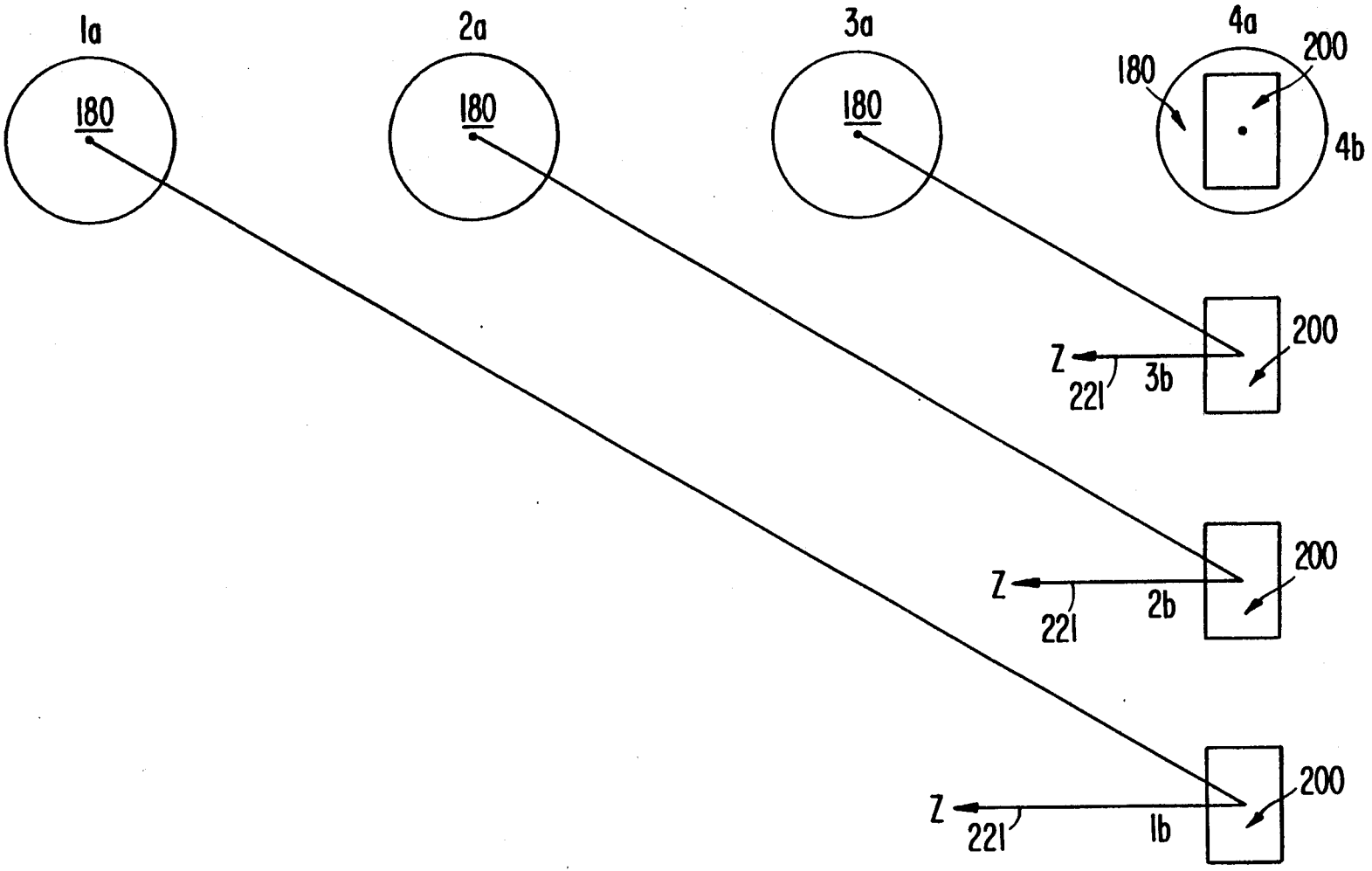
FIG. 4 illustrates how the DISK device of FIG. 1 intercepts an oncoming target.

FIG. 4 demonstrates how the DISK device positions itself to intercept an airborne target 180. The DISK device 200 senses an angle between target 180 at position 1*a* relative to the spin axis 221 of the DISK body 210 located at position 1*b* and corrects the angle for precession error and also for spin error, as discussed previously. Upon the target 180 moving to position 2*a* the DISK device in its attempt to keep the difference between the calculated angle between the target 180 at position 2*a* and the z axis 221 of the DISK device 200 relative to the angle at position 1*a*, at zero moves to position 2*b*; again, when the target 180 moves to position 3*a* the device 210 again moves to position 3*b* to continue to have the relative angle rate between the target 180 and DISK's axis 221 at zero. This continues until, as shown here, the target 180 reaches position 4a where the DISK 200 must come in contact with the target 180 in order to maintain the relative angle of zero.

The DISK device employes a number of discrete impulse thrusters which individually produce a quantum change in directed disk velocity of magnitude, DELVI. In a base DISK concept, DELVI was intended to be approximately five meters per second, and preliminary sizing suggests that between 32 and 64 discrete thrusters are appropriate. The sizes of all the individual thrusters 250 need not be constant, however, and may preferably be staggered, but proportional, to achieve gross, larger scale velocity changes earlier in the maneuver and fine, smaller scale changes as the target is approached. A combination of 4×, 2× and 1× thrusters 250 coupled with a suitable fire control program which includes firing 4× thrusters first, 2× second, etc. may be desirable, together with appropriate changes in DELVI to reflect the different velocity quantum increases. Computer simulations illustrate the reasonableness of between 32 and 64 discrete thrusters 250 for a variety of thruster configurations, however.

Pursuing a nominal approach velocity between the DISK and its intended target, VT, to be on the order of 100 meters per second and selecting a proportional navigation constant of 10 to ensure adequate performance margins, the nominal VELOCITY-GAIN-PRODUCT, VFAC, is selected to be on the order 1,000 meters per second. Accordingly, the angular change threshold or limit for initiating a discrete thrust, GTHR, is;

$$GTHR = DELVI/VFAC$$

which is on the order of 0.005 radians of cumulative target relative motion.

The DISK guidance procedure is essentially the same in both radial and rotational guidance axes. Consider first the radial axis. The body fixed DISK sensor 220 detects the target at the beginning of a control cycle. All observed values of RHO are corrected to a compensated value via the relationship;

$$ERHO = ATAN[TAN(RHO) + ESTRY]$$

As explained earlier, this formulation compensates for the precession of the DISK body. The initial value of ERHO is stored temporarily and subsequent values of ERHO during the control cycle are compared to this stored initial value until a difference equal to or greater than GTHR in magnitude occurs. In principle, one or more of discrete thrusters 250 is then selected and fired when it has rotated to an angle such that the direction of the thrust impulse is along the axis between DISK and the target intercept path. By timing it appropriately, the polarity will be toward the target path if the change in ERHO threshold exceeded is positive and the polarity will be directed away from the target if the change in ERHO is negative.

In practice, however, it has been found desirable in the early stage of DISK guidance to require that at-least-N agreements in polarity at successive threshold exceedances occur before each thruster firing initiation. This simple logical process is a useful mechanism for reducing the number of early "false alarm" firings that occur. These "false alarm" firings occur due to sensor noise and residual precessional influences, since the observable angular motion between the DISK and the target is initially relatively small, and a large number of subsequent control corrections are required to compensate for misfirings during the early guidance stage.

Conversely, for DISK application scenarios in which large maneuvers are required, it is useful to "schedule" a series of multiple discrete thruster firings during the early guidance stage or employ proportionally larger thrusters for initial firings in the sequence, as mentioned earlier. When this strategy is employed it is especially important to employ at-least-N logic to insure that the minimal possible number of (large impulse) misfirings occur.

The scheduling of at-least-N logic and multiple discrete thrust sequences, for some application scenarios, is important to the successful employment of DISK. DISK scheduling is the responsibility of the off-board fire control subsystem of dispenser 120 (see FIG. 1). In this way, the unit cost of DISK is held to a minimum. The fire control schedule is not required for most point defense application but can be important for certain air defense type applications including the long range anti-helicopter mine applications.

At the completion of each discrete thrust correction the previously stored value of ERHO is discarded and a new initial value of ERHO is measured and stored in memory of processor means 305 for subsequent threshold exceedance comparisons. The same process is employed in the rotational guidance axis where, in this case, the compensated guidance parameter is:

$$EANG = THETA - ATAN(ESTRx/[TAN(-RHO) + ESTRy])$$

The initial value of EANG is temporarily stored and compared to subsequent values for threshold exceedance. In the event of threshold exceedance, the timing of the discrete thrust event using axial thrusters 260 is selected to produce a discrete change in DISK velocity parallel to the z axis with the appropriate polarity. The same at-least-N logic and thruster scheduling applies to the rotational guidance axis. In practice, although the ERHO and EANG measurement in comparison processes are implemented separately, they are combined at the time of selection of thrust impulse direction. The resultant orientation of the discrete impulse vector is selected in accordance with the DISK relationship:

$$DIRECTION = ATAN\ (WEIGHTED\ CHANGE\ IN\ EANG/ACTUAL\ CHANGE\ IN\ ERHO)$$

This has the desirable properties of both improving thruster utilization efficiency and improving terminal homing accuracy. Under control of the off board fire control subsystem at DISK launch initiation, the weighting strategy on the change in EANG (rotational axis guidance error) may be selected to de-emphasize early state control in the rotational axis in order to provide greater early stage emphasis on reducing the primary error component, which is usually in the radial axis direction. Whether weighted directivity is employed in the early guidance stage, or not, equal weighting of the two orthogonal error components is always employed during the final terminal guidance stage, for best terminal accuracy.

One should be aware of the fact that each "discrete impulse" is in fact not an instantaneous event; it requires a finite amount of time, assumed to be on the order of ten milliseconds for the thruster to burn. The "smeared"

rotating impulse is not expected to burn uniformly, resulting in some uncertainty as to the net direction of the resultant discrete change in DISK velocity vector. Fortunately, variations in impulse direction of 20 to 30 degrees and variations in impulse magnitude of 20 to 30 percent are quite acceptable, having little net influence on DISK maneuverability or accuracy. This is expected since modest errors in earlier control events will cumulatively correct over subsequent control events, and since moreover, their presence and influence will largely be masked by DISK sensor resolution and precessional modulation error effects.

The theoretical performance of proportional navigation, in the absence of sensor noise, provides a useful benchmark against which DISK guidance performance can be compared. Since it is described extensively in the prior art, this section will only highlight certain properties. In theory, proportional navigation is characterized by the following:

$$MISS=(TTG^2)*VT*VRx$$

$$d(VRx)/dt=(2/TTG)*VRx+(1/TTG)*Ax/VT$$

$$Ax=-LAMBDA*VT*(VRx-measured)$$

wherein TTG is a remaining time-to-go to intercept, VT is the closure velocity, VRx is the relative rate of change in line of sight, LAMBDA is termed the "proportional navigation constant," and Ax is the acceleration produced in response to the proportional navigation law. Accordingly;

$$VRx=VRx_o*[(TTG/TTG_o)^{(LAMBDA-2)}]$$

$$MISS=MISS_o*[(TTG/TTG_o)^{(LAMBDA)}]$$

The first equation illustrates that a bounded line-of-sight will result only for LAMBDA<2. Typically, LAMBDA is selected to be at least 4, to insure LOS rate stability. For the above relationships, the terminal value of MISS will then reduce to 0 as TTG approaches 0, producing theoretically perfect terminal accuracy.

A variety of practical considerations cause DISK guidance to fall short of the above ideal. First the DISK guidance utilizes a variant of the equation: Ax=−LAMBDA*VT*(VRx−measured) which is: DELVI=−(LAMBDA*VT)*(integral of VRx−measured), where DELVI is a discrete impulse, which cannot be provided more often then once each three disk revolutions (3×T) i.e., two revolutions to measure the change in LOS angle, and a third revolution to rotate the selected thruster and produce a directed impulse in the desired orientation. Therefore, the discreteness of the terminal accuracy is:

$$DELMISS=3\times T\times DELVI$$

For example, a spin period of 0.05 seconds and a discrete impulse of five meters per second will provide the value of DELMISS of 0.75 meters, which would be perfectly adequate for intercepting a helicopter or fixed wing aircraft, for example, but would not be a good design choice for intercepting an incoming 18-inch diameter missile. Reducing either the discrete impulse, DELVI, or spinning faster to reduce the spin period, T, or both, would serve to reduce the discreteness in terminal homing performance to a more suitable level for missile intercept.

Another consideration that causes performance of the DISK to depart from the above ideal is the "saturation" of available maneuver acceleration. The theoretical limit on available DISK maneuver acceleration is:

$$ALMIT=DELVI/(3*T)$$

which for the above example:

(DELVI=5 meters per second, T=0.05 seconds), corresponds to 33.3 meters per second, which is about 3.5g's. The DISK fire control logic that employs multiple thrust firing or proportionately sized thrusters will increase this limit considerably, but the point remains that the DISK implementation of the proportional navigation law can only result in limited control acceleration.

In addition, DISK measurement errors result from a variety of sources which include sensor resolution, DISK spin rate uncertainty and uncompensated precessional modulation as dominant factors; therefore, a certain fraction of the time, erroneous DISK thruster firings will be produced which serve to further degrade the quality of DISK guidance. A feeling is readily developed for acceptable error source levels by recognizing that a DISK thruster firing will only be initiated when the observed change in relative line-of-sight angle including error sources, exceeds the threshold level GTHR. For the above example, DELVI=5 meters per second, T=0.05 seconds and a choice of LAMBDA*VT =1,000 meters per second, the threshold angle is equal to 0.005 radians. Thus, any zero mean error source with an RMS value of only one to two milliradians is unlikely to stimulate an erroneous DISK thruster firing.

By this logic it would seem desirable to simply increase the threshold to a very large value, to eliminate concern with the measurement error; however, this threshold also establishes the sensitivity of the DISK guidance to existing miss distance errors. In DISK guidance the first spin period is used to measure a baseline LOS angle. The second spin rate period observes a change in the LOS angle from the baseline value and if large enough to exceed the threshold, will result in a third DISK spin period being used to implement a DISK maneuver acceleration. In order to avoid limiting the available DISK maneuver acceleration, it is important that the threshold be set low enough to create a threshold exceedance within the three spin period interval, for sufficiently large miss distance errors. If the threshold were set to just result in threshold exceedance at the end of the second spin period, this would correspond to the condition:

$$GTHR = DELVI/(\text{LAMBDA} * VT) = T * VRx = \frac{T * \text{MISS}}{(VT*TTG^2)}$$

rearranging this relationship it follows that the value of MISS to just produce threshold exceedance within the spin period interval corresponds to:

$$MISS=(6/LAMBDA)*(0.5*(DELVI/(3*T))*TTG2)$$

Since the second term on the right hand side of the above equation is the DISK maneuverability limit it follows that selection of LAMBDA must equal or exceed six in order to avoid unduly restricting DISK maneuverability. To provide a performance margin the preferred DISK design choice for LAMBDA is ten.

Therefore, if the maximum approach velocity between the target and the DISK is expected to be on the order of 100 meters per second (i.e., a tilt rotor class helicopter) then the selected value of VFAC=-DELVI/ (LAMBDA*VT) must be at least 1,000 meters per second and therefore the value of the threshold GTHR in the previous example cannot be increased beyond the level of 0.005 radians. In order to accommodate measurement errors, there remains little alternative except to maintain DISK design specifications which insure that the individual error sources do not produce measurement errors in excess of a few milliradians.

The DISK sensor provides target centroid detection, with resolution uncertainty in both radial angle and in the rotational-angle-at-detection occurrence. The uncertainty in the DISK rotational angle at the detection occurrence relates solely to the effective uncertainty in time of occurrence of the pulse as radiation (or reradiation) from the target sweeps across the DISK sensor. The time separation between successive target detections provides the basic guidance information upon which DISK rotational guidance corrections are made. It is readily shown that an acceptable angular uncertainty in locating the occurrence of a sweeping pulse centroid is on the order of 0.005 radians, in the rotational direction. Fixed biases have no effect, and therefore do not restrict the actual width of the beam as long as some combination of leading edge, trailing edge, or energy centroid detection produces an uncertainty in the occurrence with a nonstationary RMS magnitude no greater than 0.005 radians.

The uncertainty in the target relative radial angle at detection, relates solely to the resolvable uncertainty in the differences in successive measurement of changes in the radial angle, therefore, scale factor errors and biases have no effect on DISK guidance. Accordingly, the major consideration in the radial axis measurement is the pixel length of sensor 220 or its equivalent, depending on the type of sensor employed. An acceptable RMS radial resolution error is on the order of 0.002 to 0.003 radians, in order to insure that successive differences in measured radial angle do not exceed the nominal guidance threshold of 0.005 radians.

In low cost design, a manufacturing tolerance must be allowed for thrust misalignment. The employment of DISK discrete thrusters will therefore produce an undesired torque which depending on random operation, will cause some combination of precession and despin. The magnitude of discrete change in DISK angular rate at an individual thruster firing will result as;

$$DELOMEGA = 6*DELVI*BORE/DIAMETER$$
(radians per second)

wherein BORE is the angular misalignment of discrete impulse in radians, DELVI has been previously introduced as the velocity impulse magnitude in meters per second, and DIAMETER is the DISK diameter in meters. Since the misalignment is presumed to be zero mean, the cumulative influence of DISK thruster firings will be the random walk growth in both precession and despin.

Consider that typically the DISK diameter is expected to be on the order of 0.2 meters and the DELVI is expected to be on the order of 5 meters per second. The expected number of DISK impulse firings over a complete intercept is likely to be on the order of about 36. Thus, for example, a 10 milliradian tolerance aligned to the thruster impulse is expected to produce cumulatively a net change in DISK angular rate of;

$$NET\ RATE\ CHANGE = (6*5*0.010/0.2)*SQRT(36) = 9 \text{ radians per second}$$

For an initial DISK spin rate of 20 revolutions per second this would correspond to a net change in spin rate of about 5 to 10 percent. The significance of the spin rate change will be discussed later. The formulas used to calculate precessional angular rates and precessional angles can be utilized to calculate the net angle change. The net angle change is expected to equal $$NET\ ANGLE\ CHANGE = NET\ RATE\ CHANGE/PRERAT$$

which for the above example would correspond to 0.050 to 0.100 radians of precession for a design moment of inertia ratio KO, equal to 2. As explained earlier, the DISK procedure for measuring a biased estimate of the precessional angle via the predetermined precessional rate corresponding to the nominal 2:1 design inertial moment ratio and actual deviations measured by appropriately mounted and balanced accelerometer couples 510, 520 and 530, 540, will tend to offset this effect, but, for a minimum cost design, it is important that the tolerance requirement on the accelerometer couple not be stringent.

Presuming that an accelerometer matching tolerance of 5 percent will accommodate the lowest possible cost, it would follow the effect of a net growth in precession to 0.100 radians would be reduced to 0.05 times its uncompensated level, in terms of its influence on DISK sensor rate error. It can be shown from the equations calculating TAN (RHO')−TAN (RHO) and the formula for calculating THETA'−THETA that:

$$Guidance\ Precess\ Error\ Angle = Net\ Angle\ Change*Ace*(Ek*2\pi)$$

where Ek was introduced as the normalized tolerance in the manufactured moment of inertia ratio. In the above example, a tolerance for Ek of 0.10 (i.e. 10%) would produce a guidance error angle due to uncompensated precession of about 0.0025 radians or of about one-half of the nominal guidance threshold value for GTHR of 0.005 radians. As explained earlier, this would be expected to provide marginal but acceptable DISK terminal guidance performance. The design margin can be easily improved by simply imposing a tighter accelerometer matching tolerance, i.e., say ACE=0.02 (i.e. 2%).

It was shown that the net cumulative effect of multiple thruster firing is expected to produce a corresponding "random walk" change in DISK spin rate of as much as 5 to 10 percent of its initial value, over a completed DISK intercept maneuver. Without compensation of some sort, this would correspond to an uncertainty of elapsed spin for each spin period of 0.6 radians for an initial spin rate of 20 revolutions per second. The effect of uncertainty in target rotational axis rate accordingly would be on the order of 6 radians per second. This would completely mask the actual target angle rate produced by the miss distance, since, as shown earlier, the relationship between target line of sight rate and miss distance is:

TARGET LOS RATE =

$$\frac{\text{(MISS DISTANCE/CLOSURE VELOCITY)}}{(TTG^2)}$$

For example, a 5 meter miss distance at 1 second to go to intercept for closure velocity of 100 meters per second would produce a target line of sight rate on the order of 0.05 radians per second; thus, an uncertainty in the DISK spin rate of 6 radians per second would produce an angular rate on the order of 100 times that produced by the actual target miss distance. Under this condition accurate terminal guidance would not be possible. An acceptable uncertainty in DISK spin rate, due to the accelerometer matching tolerance in the spin axis accelerometer couple 310, 320, represented in the calculation model by ASE, is readily established as:

$$ASE = MISS/(VT*SQRT(\# - FIRINGS)*DELOMEGA*((3*T)^2)$$

Thus, for the earlier example VT = 100 meters per second with 36 impulse firings, a spin period of 0.05 seconds, DELOMEGA = 1.5 radians per second per unit impulse firing, and an allowable 0.1 meter miss distance due to the uncertainty in the spin rate, the corresponding allowable tolerance ASE for spin axis accelerometer couple 310, 320 would be on the order of 0.005 (0.5%).

There are two major sources of despin to which the accelerometer must be responsive. The first already considered is torquing effects produced by misaligned thrust impulses. Presuming an impulse magnitude of 5 meters per second produced over 10 milliseconds burn time the largest acceleration to be measured would be on the order of 500 meters per second$^2$ or about 50g's. The other major source of despin to which the accelerometer couple must be responsive is aerodynamic rotational drag. For example, the same 9 radians per second cumulative despin from an initial spin rate of 20 revolutions per second would occur over a 10 second DISK intercept maneuver if the aerodynamic rotational drag time constant were on the order of 200 seconds. The corresponding rotational acceleration would be on the order of 1 radian per second$^2$. If a moment arm of about 0.1 meters were employed then the corresponding linear acceleration would be about 1/10th of a meter per second$^2$ or about 0.1g's. Thus a 0.005 matching tolerance would be required over acceleration range of 0.01g's to 50g's.

Although more stringent than required for the precession axis accelerometer couples 510, 520 and 530, 540, just 0.5% matching tolerance for the spin rate acceleration couple 310, 320 over a 5,000 to 1 dynamic range is not expected to have strong cost impact on DISK since this is still consistent with current commercial manufacturing standards.

Finally, note the importance of build up of inertial imbalance, Exy. This term was defined earlier and was used in the formula for the term (PRECPLX − 1)+-PRERAT. It was shown that this normalized term must be held to a value of about 0.1 in order for the bias precessional angle estimates to substitute adequately for the actual precessional angles, when compensation for DISK body fixed sensor modulation due to precession. This effect can be held to quite acceptable levels, with only a minimum of care, but cannot be ignored.

Figure 5:
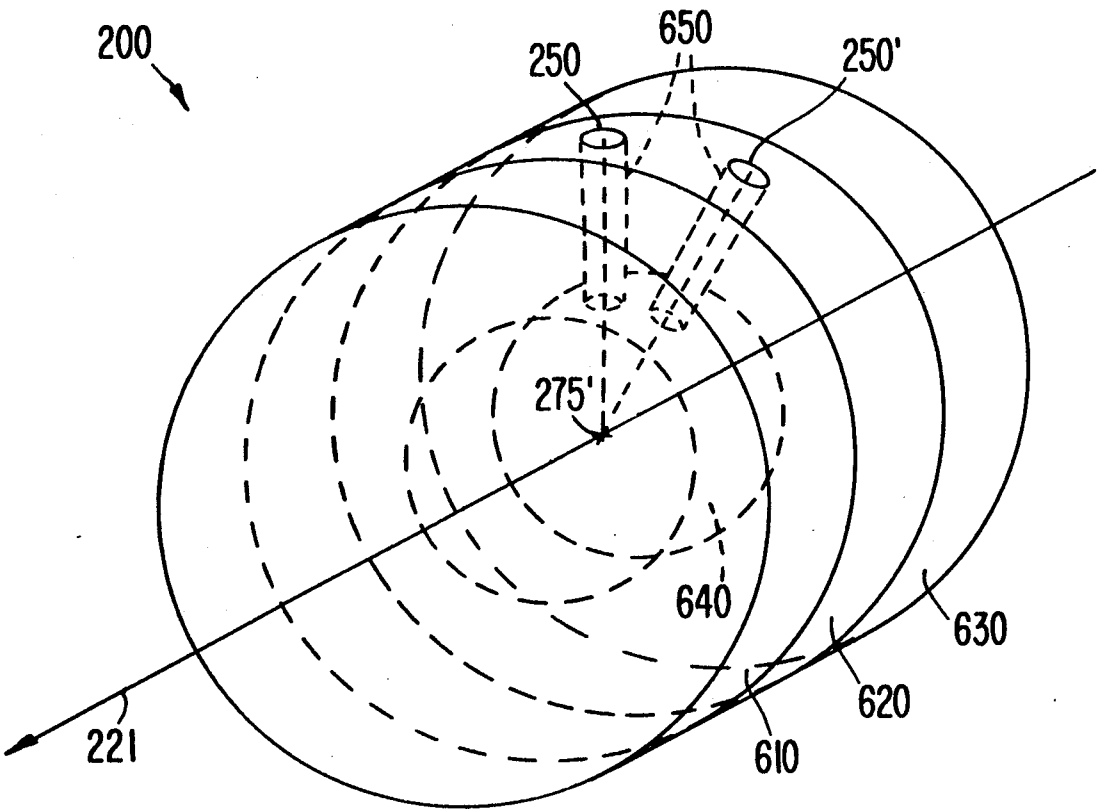
FIG. 5 illustrates the configuration for a calculational example.

Consider for example that the DISK body 200 is comprised of three layers as shown schematically in FIG. 5 as layers 610, 620, and 630. The density of the end layers 610, 630 is assumed to be essentially homogenous. These two discus-shaped layers are each of thickness, HE, and diameter, DIA, with density, Db. The inner layer 620 has the same diameter and density as the outer two layers, but has a hollow inner core. The fourth discus-shaped layer 640 is composed of propellent materials, has a density of Dp, and its diameter DIP fills perfectly the hollow core of the inner layer. The width of both the inner layer and propellant core is HP. The overall thickness of the three layers equals the thickness of the DISK body, H, and DIA is equal to the diameter of the DISK body, the discus-shaped propellant core is constructed such that the $I^{th}$ individual uniform element of its mass can be burned to provide a series of up to L discrete thrust impulses (i.e., I = 1, 2, 3, . . . L). One or more narrow exhaust ports 650 penetrate the inner layer, to allow propellant exhaust to vent at openings 250' which comprise the thrusters. Each exhaust port is normally oriented to cause it to align to the DISK center of gravity 275'.

It can be readily shown that after the first element of the propellant mass has been expended the following DISK moment of inertia is normally observed:

$$Iz = (\pi/2)*Db*H*(DIA^4)*[1-(1-(1-I/L)*Dp/Db)]*(HP/H)*(DIP^4/DIA^4)$$

$$Ix = (\pi/12)*Db*(H^3)*DIA^2*(1-(1-I/L)*(HP^3/H^3)*(DIP^2/DIA^2))$$

It is important to be aware of this relationship since it changes the DISK moment of inertia ratio, thereby altering the relationship between the DISK spin rate and the DISK precession rate which in turn affects the effectiveness of the DISK compensation method for precessional disturbances. The imbalance between the moment of inertia in the DISK x and y coordinates due to nonuniform propellant mass distribution, as successive thrusters are fired is closely approximated as:

$$Ix - Iy = (\pi/(6*L))*Dp*(Hp^3)*(DIP^2)*\cos[(\pi/2)*I/L]$$

This equation is developed under the presumption that the order of selection of thrusters is taken to minimize the net cumulative imbalances between Ix and Iy, which corresponds to the normalized imbalance, Ek. A non-unique optimum selection order is illustrated by the following relationships:

Defining the total number of thrusters 250 to be fired as; I = 1, 2, 3, 4, . . . L (Note: L is assumed to be equal to 64). Consider the circumference of the propellant mass to be divided into four quadrants, Q = 1,2,3,4. Within each quadrant there are L/4 sectors, denoted in a rotationally consistent order by J = 1,2, . . . L/4. Each sector presents propellant mass associated with one thrust impulse burn. At the $I^{th}$ firing, the particular sector J and quadrant Q that are optimum to produce minimal Ek is:

$$J = Integer((I-1)/4)+1$$

$$Q = I - 4*(J-1)$$

When combined an optimum order sequence of the thruster indices for successive firing becomes:

$$TI=[(L/4)+1-J/2]*[1+(-1)^J]^2$$

To illustrate, the first twelve thruster indices to be selected for firing by this firing selection rule would correspond to the sequence:

$$TI=(1, 17, 33, 49, 16, 32, 48, 64, 2, 18, 34, 50 \ldots)$$

It is important to note that this firing selection rule is only one of a large number of possible selection rules that could be devised to produce the same net affect (i.e., minimum net build up in Exy). DISK simulation, treating the imbalance term Exy parametrically, shows that a normalized imbalance of as much as 0.1, can be tolerated using the above thruster selection rule. The maximum imbalance due to the change in DISK density distribution as propellant masses expended will not exceed the order of 0.01. Therefore, it is not strictly necessary to rigidly maintain this or a comparable firing sequence rule. This also shows that monitoring each activated thruster to determine normal firing/dud is not required for the present navigation method and distinguishes many conventional systems which seek to minimize or eliminate precession entirely and which, of necessity, must monitor each firing and strictly account for any misfirings.

It will be apparent to those skilled in the art that various modifications and variations can be made in the above-described embodiments of the present invention without departing from the scope of spirit of the invention. Thus, it is intended that the present invention cover such modification and variations provide they come within the scope of the appended claims and their equivalents.

What is claimed is:

1. Method of navigating a spinning body for intercepting an object, the body having a spin axis and a resultant angular momentum vector, an axial end face with object sensor means located thereon, and propulsion means including discrete thruster means, the method comprising the steps of:

sensing the angular position of the object with respect to the body spin axis using the sensor means;

correcting the sensed angular position of the object for angular position error due to precession of the body, said correcting step including the step of estimating the angular error between the body spin axis and the angular momentum vector of the body, the estimating step including the substeps of (i) calculating a predetermined precession rate relative to the spin rate, the method including the preliminary step of inducing the body to precess about its angular momentum vector at the predetermined rate, (ii) determining actual deviation in the body precessional rate and adjusting the calculated angular error based on the determined deviation;

comparing the corrected object angular position with a predetermined object angular position to compute a difference; and firing the discrete thruster means to provide one or more discrete thrusts in a direction to reduce the difference when the difference exceeds a predetermined limit.

2. The spinning body navigation method as in claim 1 wherein the discrete thruster means includes a plurality of discrete radial thrusters distributed about the periphery of the body in a plane orthogonal to the spin axis and passing through the CG of the body, and a plurality of discrete axial thrusters positioned along the spin axis, wherein said firing step includes the step of selecting from among the radial and axial thrusters one or more thrusters to be fired.

3. The spinning body navigation method as in claim 1 wherein said precession inducing step includes configuring the body to have an asymptotically imbalanced moment of inertia about the spin axis.

4. The spinning body navigation method as in claim 1 wherein the body is substantially cylindrical and spins about it longitudinal axis, the precession inducing step including configuring the body to have a nominal moment of inertia ratio of about 2:1.

5. The spinning body navigation method as in claim 1 wherein said actual deviation determining substep includes ascertaining the acceleration of the body about each of a pair of mutually orthogonal axes which are also orthogonal to the body spin axis.

6. The spinning body navigation method as in claim 1 wherein the correcting step includes correcting for the angular position error due to changes in the spin rate of the body.

7. The spinning body navigation method as in claim 6 wherein said correcting step includes the step of ascertaining the acceleration of said body about the spin axis.

8. The spinning body navigation method as in claim 1 wherein the predetermined object angular position is a corrected sensed object angular position from a preceding spin period.

9. The spinning body navigation method as in claim 1 wherein said firing step includes the step of firing in a sequence to minimize changes in the moment of inertia ratio of the body.

10. The spinning body navigation method as in claim 9 wherein the discrete thrusters include a plurality of radial thrusters having associated masses distributed about the circumference of the body, and wherein the thrusters are fired in a sequence defined by the equation:

$$TI=[(L/4+1-J/2]*[1+(-1)^J]^2$$

where:

L is the total number of radial thrusters.

J=Integer [(I−1)/4]+1, and

I is the thruster index.

11. A projectile for a target intercept system wherein the projectile is rotatably spun upon launch, the projectile comprising:

a body having a spin axis, an axial end face, a center of gravity CG, and, following launch, an angular momentum vector;

controllable discrete propulsion means positioned on said body for propelling the projectile at least in a plane normal to said body spin axis and passing through the body CG;

target sensing means for sensing target angular position with respect to said body spin axis, said target sensing means including a sensor positioned on said axial end face and spaced from said spin axis;

means for inducing said body to precess about its angular momentum vector at a predetermined rate relative to the spin rate;

navigation means carried by said body and operatively connected to said target sensing means and to said discrete propulsion means, for controlling said propulsion means, said navigation means including (a) means for correcting the sensed target angular position for angular position error due to precession of said body, the correcting means including means for estimating the angular error between the spin axis of said body and the angular momentum vector of said body, said estimating means including
  (i) means for calculating an angular position error based on the predetermined precession rate, and
  (ii) means for determining actual deviation in the body precession rate and adjusting said calculated angular position error based on the determined deviations, and
(b) means for comparing the corrected target angular position with a predetermined angular position to compute a position difference and for activating said discrete propulsion means to propel the body in a direction to decrease the difference whenever the difference exceeds a predetermined limit.

12. The projectile as in claim 11 wherein said propulsion means includes a plurality of discrete radial thrusters distributed about the periphery of said body in a plane orthogonal to said spin axis and passing through said body CG.

13. The projectile as in claim 11 wherein said precession inducing means includes a body mass distribution relative to the spin axis of said body yielding an asymptotically imbalanced moment of inertia about the spin axis.

14. The projectile as in claim 11 wherein said projectile body is substantially cylindrical with the spin axis being the longitudinal axis of the cylinder, and wherein said precession inducing means includes a mass distribution about the spin axis yielding a nominal moment of inertia ratio of 2:1.

15. The projectile as in claim 11 wherein said deviation determining means includes means for measuring the acceleration of the projectile body about each of a pair of mutually orthogonal axes which are also orthogonal to the body spin axis.

16. The projectile as in claim 15 wherein said measuring means includes two pairs of nominally matched accelerometers mounted in said body in coupled, opposed relationship in a mounting plane orthogonal to the spin axis of said body, each of said accelerometer pairs being orthogonal to the other of said pair, and each accelerometer of each of said two pairs being aligned to be sensitive to linear acceleration in the spin axis direction.

17. The projective as in claim 16 wherein the mismatch between the nominally matched accelerometers of each of said two pairs is about 10% or less.

18. The projectile as in claim 15 wherein said mounting plane passes through the CG of said body.

19. The projectile as in claim 11 wherein said target angular position correcting means further includes spin error correcting means for correcting the sensed target angular position errors due to changes in the spin rate of the body.

20. The projectile as in claim 19 wherein said spin error correcting means includes means for measuring the acceleration of said body about the spin axis.

21. The projectile as in claim 20 wherein said measuring means includes a pair of nominally matched accelerometers mounted in coupled, opposed relationship in said body in a mounting plane orthogonal to the spin axis of said body, each accelerometer of said pair being aligned to be sensitive to linear acceleration along a direction orthogonal to the spin axis of said body.

22. The projectile as in claim 21 wherein the mismatch between the accelerometers of said nominally matched pair is about 0.5% or less.

23. The projectile as in claim 21 wherein said mounting plane passes through the CG of said body.

24. The projectile as in claim 11 wherein said discrete propulsion means includes about 32 to 64 solid propellant thrusters spaced about said body periphery in a plane passing through said body CG.

25. The projectile as in claim 11 wherein said body further includes an opposed axial end surface, and wherein said propulsion means also includes axial thruster means positioned on said opposed end surface for propelling said projectile along said spin axis.

* * * * *